United States Patent [19]

Bowman

[11] 4,281,944

[45] Aug. 4, 1981

[54] MANHOLE COVER SUPPORT

[76] Inventor: Harold M. Bowman, 18867 N. Valley Dr., Fairview Park, Ohio 44126

[21] Appl. No.: 73,910

[22] Filed: Sep. 10, 1979

[51] Int. Cl.[3] ..... E01D 7/00

[52] U.S. Cl. ..... 404/26; 210/163; 52/20

[58] Field of Search ..... 404/26, 25; 210/163, 210/166; 52/19, 20, 21

[56] References Cited

U.S. PATENT DOCUMENTS

| | | | |
|---|---|---|---|
| 1,384,712 | 7/1921 | Shanley | 404/25 |
| 1,987,502 | 1/1935 | Born | 404/25 |
| 2,593,918 | 4/1952 | Redman | 404/26 |
| 3,218,943 | 11/1965 | Bowman | 404/26 |
| 3,773,428 | 11/1973 | Bowman | 404/26 |
| 3,891,337 | 6/1975 | McCoy | 404/26 |
| 3,968,600 | 7/1976 | Bowman | 404/26 X |
| 4,097,171 | 6/1978 | Fier | 404/26 |
| 4,158,515 | 6/1979 | Helms | 404/26 X |
| 4,187,647 | 2/1980 | Hall | 404/26 X |
| 4,188,151 | 2/1980 | Hall | 404/26 |

*Primary Examiner*—Nile C. Byers, Jr.

*Attorney, Agent, or Firm*—Baldwin, Egan, Walling & Fetzer

[57] ABSTRACT

An adjustable support for varying the height of a manhole cover after a street surface has been resurfaced is presented including vertically disposed posts in a downward position on each end of each adjustable section. These posts provide the location for bolts connecting adjacent ends of two adjustable sections so that the entire structure permits the units to be expanded and contracted to fit a plurality of different diameters of manholes. Also an upwardly extending radially outwardly positioned projection on the outer surface of the base member of the adjustable section ensures a more stable engagement of the base member of the adjustable section with the manhole housing on which it is adapted to rest.

9 Claims, 13 Drawing Figures

MANHOLE COVER SUPPORT

FIELD OF THE INVENTION

This invention relates to raising a manhole cover in a pavement to a higher level corresponding to a new pavement level caused by resurfacing.

DESCRIPTION OF THE PRIOR ART

Applicant's prior patents U.S. Pat. No. 3,773,428 of Nov. 20, 1973, and U.S. Pat. No. 3,968,600 of July 13, 1976 are related to similar problems.

SPECIFICATION

It will be understood that in the repair of resurfacing of streets and highways, usually the resurfaced roadway is somewhat higher than the original roadway so that the upper surfaces of numerous manhole housings are disposed below the new road surface. This lower position of the manhole covers creates hazardous driving conditions.

SUMMARY OF THE INVENTION

A purpose of this invention is to provide a manhole cover support wherein there is provided a sectional, circumferentially expansible base member which may be adjusted radially outwardly to compressively engage the upper end portion of the manhole housing when in use.

Another object of the invention is to provide a sectional manhole cover support having an upwardly radially outwardly extending projection on the base member of the adjustable unit which would provide a more stable engagement with the manhole housing on which it is adapted to rest.

Other objects and advantages of the invention will be apparent from the accompanying drawings and specification and the essential features thereof will be set forth in the accompanying claims.

BRIEF DESCRIPTION OF THE DRAWINGS

FIG. 2 in this embodiment is as it was in the first described embodiment;

FIG. 12 is an elevational view of FIG. 11 to which has been added a sealing ring and a lateral support member; while

FIGS. 3 and 6 show in section a portion of a standard manhole housing 10 having an annular recess round its upper edge 11 and 11' which has a flat horizontal bottom wall **11*a* and 11*a'* and an associated radially outer wall 11*b* and 11*b'* sloping upwardly and radially outwardly at a slight angle to the bottom wall 11*a* or 11*a'***.

The recess normally receives the outer edge **12*a* of a manhole cover 12** in the original construction of the street surface.

This invention provides an adjustable support for use with the manhole housing after the street surface 13 has been raised by the addition of a top surface 14.

Figure 1:
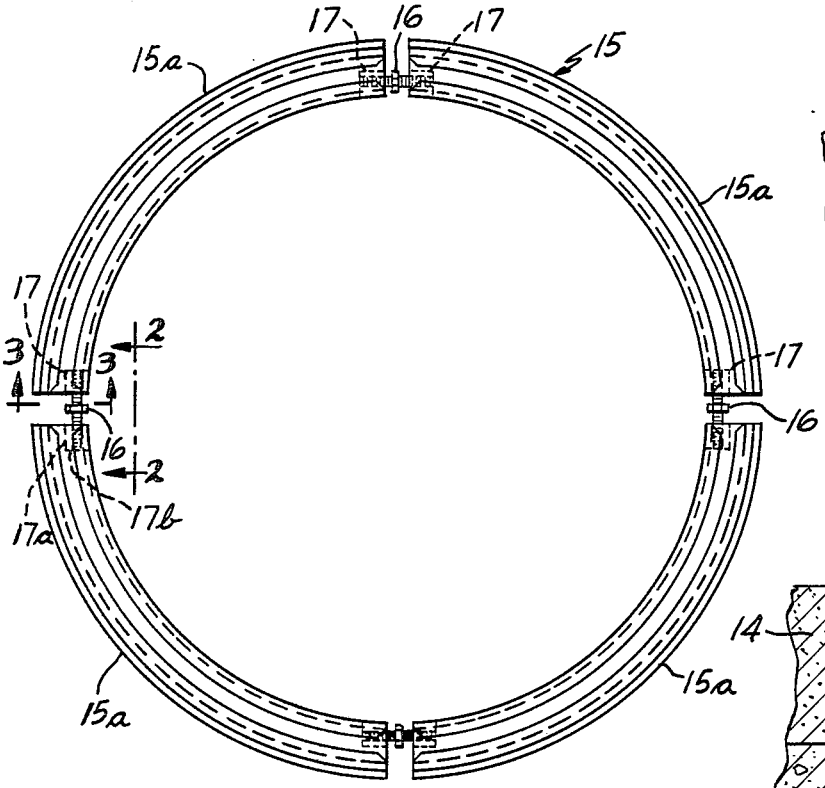
FIG. 1 is a top plan view of one embodiment of this invention assembled for use in the top of a manhole housing.

The first embodiment of this invention shown in FIGS. 1 to 4 provides a generally channel shape arcuate base member 15 made in four sections, each a little less than 90° in extent, and adapted to be assembled in a generally circular configuration as seen in FIG. 1 by connecting four of the base members **15*a* by adjustable bolt connections 16. The novelty here is that vertically disposed posts 17 are integrally provided extending in a downward position on each end of each adjustable section 15*a*. Each of these posts has two walls, 17*a* and 17*b*, constructed at approximately right angles to each other as seen in FIG. 1**.

It will be noted that each of the base members **15*a* is of generally channel shape opening upwardly and following the arc of the sectional part of the unit. As clearly seen in FIG. 3 the inner walls of each channel-shape section 15*a* provide inwardly projecting teeth 18, each tooth having a horizontal, flat upper surface 18*a* and an oblique lower surface 18*b*. The upper surfaces 18*a* of each tooth is coplanar with the tooth directly opposite on the other side of the channel, and each lower surface 18*b* is directed downwardly and laterally outwardly of the channel 15*a*. These teeth 18 enable small increments of adjustment to be made to the elevating section 19** while providing strong supporting surfaces for the elevating sections presently to be described.

Figure 2:
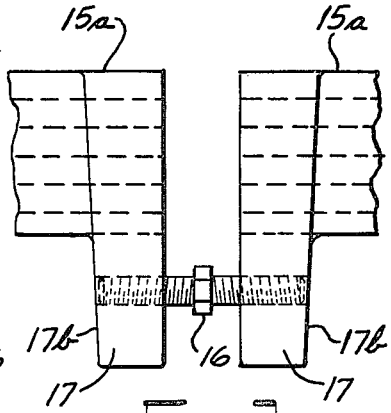
FIG. 2 is a fractional elevational view taken along the line 2—2 of FIG. 1.

Each base member **15*a* has an integral downwardly extending post 17 at each end thereof as clearly seen in FIGS. 1 and 2. This is an improvement over the structure shown in my previous U.S. Pat. No. 3,218,943 granted Nov. 23, 1965 which relied upon bosses 27 located generally at the same horizontal level as the base member. These posts 17 are drilled and tapped as indicated at 17*c* in FIG. 3 in the generally radially extending wall 17*b* to receive one end of an adjusting bolt 16. Each adjusting bolt has a noncircular gripping portion 16*a* and other bolt portions extending in either direction from the gripping portion having right- and left-hand threads. The posts 17 at 17*c* are provided with internal right- and left-hand threads respectively at opposite ends of the bolt connection whereby the base members 15*a* may be drawn together or expanded by turning the bolt connections in opposite directions to enable the base to accommodate a plurality of diameters of manhole housing openings. By having these bolt connections located in the posts 17** as above described, a greater leverage is provided than if the bolt connections were in bosses at the same level as the base member.

Figure 3:
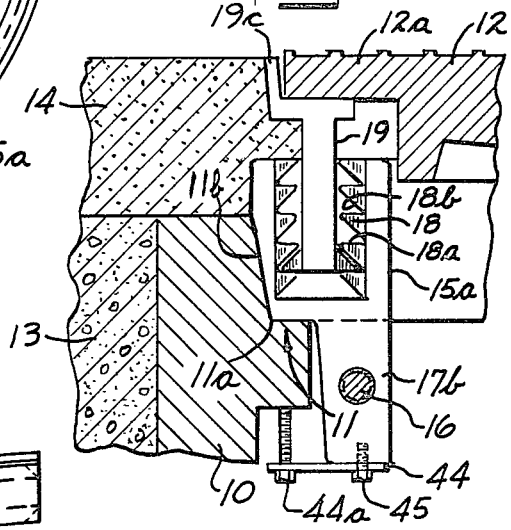
FIG. 3 is a fractional elevational view enlarged taken along the line 3—3 of FIG. 1.
Figure 4:
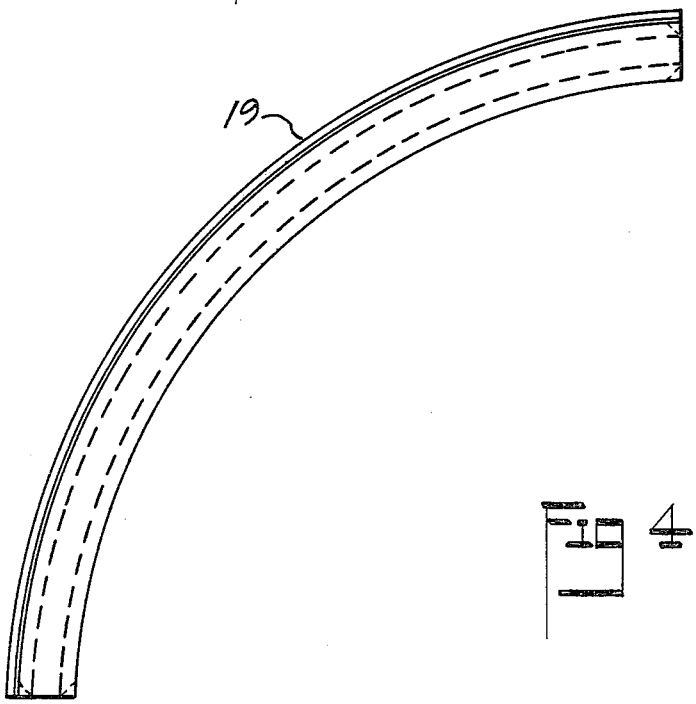
FIG. 4 is a top plan view of one of the sections of a vertically adjustable elevating member for assembly upon the base member shown in FIG. 1.

FIGS. 3 and 4 show an elevating section 18 which is arcuately formed about the same radius and extends substantially the same circumferential distance as the base members 15*a* upon which they are mounted. In section, as shown in FIG. 3, the elevating section includes a vertical arcuate member indicated at 19 and a dovetail base 19*a* which fits into the notches formed between the teeth 18 as previously described. At the upper end of the vertical wall 19 there is a horizontal ledge portion 19*b* which extends horizontally radially outwardly and then upwardly at 19*c* at a slight angle diverging radially outwardly. The adjustable elevating member 19 is so formed as to slidably interfit with the central opening in the base member 15*a*. In use, the coacting members 15*a* and 19 are fit together before the assembly of the generally circular ring 15.

Referring to FIG. 3, another novel feature of this invention will be seen. Here the lower portion of the radially outermost base of the base member 15*a* is provided with an outwardly and upwardly diverging surface 15*b* which is inclined at a small angle, preferably about 9° 30″ to the vertical. Preferably, this is the same angle as that found in the inclined wall 11*b* of the manhole housing so that when the assembled ring 15 is placed within the housing, and expanded outwardly by use of the bolt connections 16, then the mating surfaces 11*b* and 15*b* provide a tight fit which improves the stability of the manhole cover.

Figure 5:
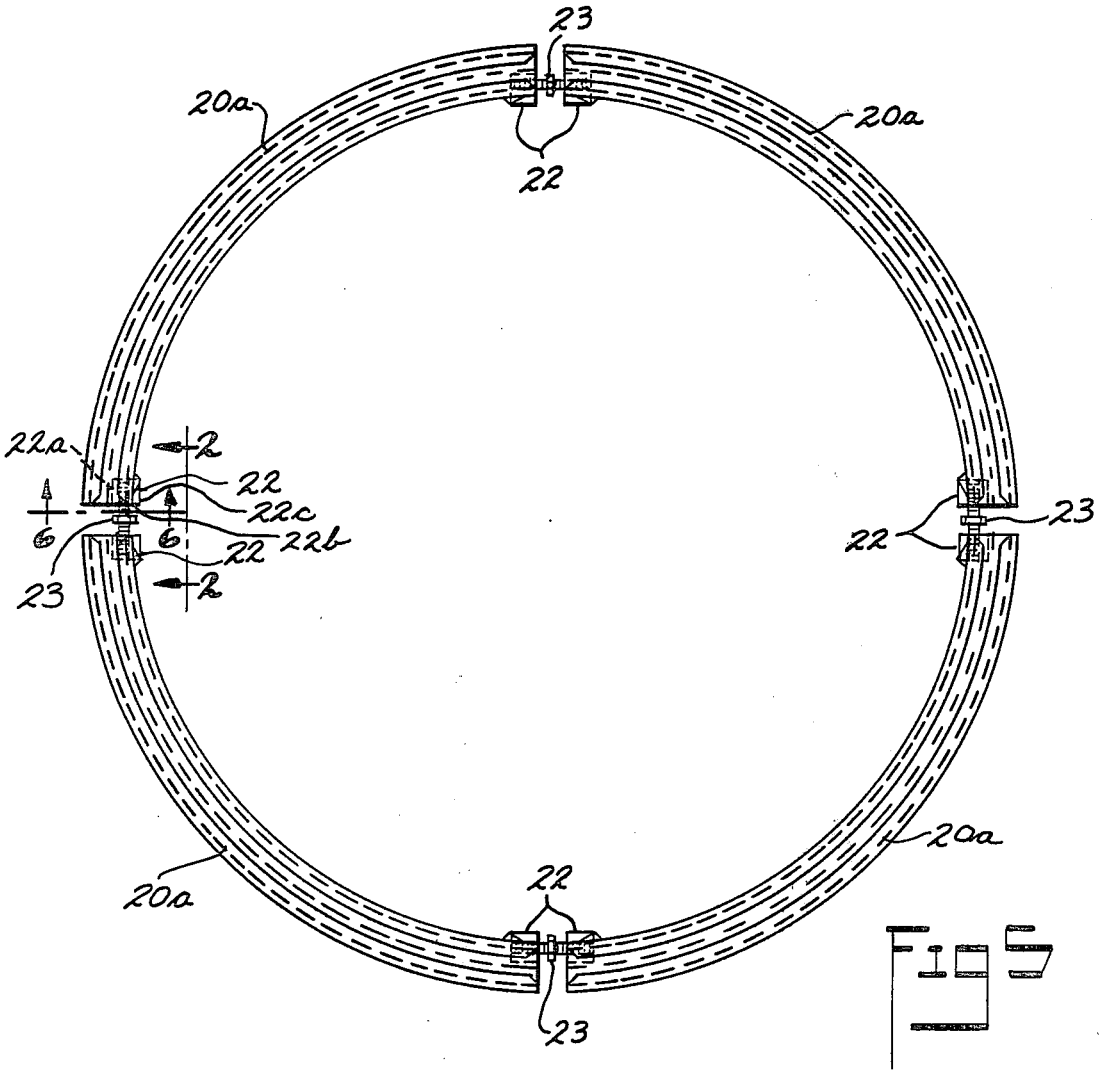
FIG. 5 is a top plan view of a second embodiment of this invention of the base members of the assembly connected by bolt means so as to be expanded and contracted in a manhole cover top.
Figure 6:
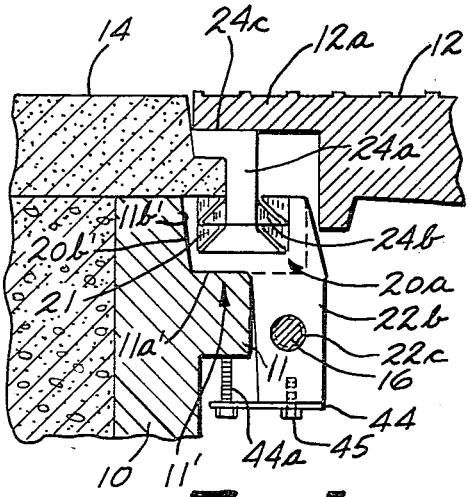
FIG. 6 is a fractional sectional view enlarged taken along the line 6—6 of FIG. 5.
Figure 7:
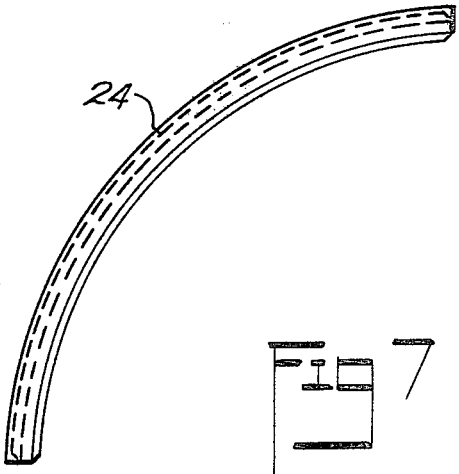
FIG. 7 is a top plan view of a form of vertically adjustable elevating member to be assembled on each of the base sections shown in FIG. 5.

A second, slightly different, form of the invention is shown in FIGS. 5, 6 and 7. Here, the ring 20 assembled as shown in FIG. 5, is composed of four arcuate base members 20*a*, each formed in channel section as shown in FIG. 6 with the parallel walls of the channel of the base member 20*a* having inturned pairs of teeth 21 horizontally opposite each other exactly as described in the first embodiment. Each base member has at its opposite ends an integral vertically downwardly extending post 22 which in this case is extended inwardly a small amount from the innermost wall of the base member as clearly seen in FIG. 6. Each post has a radially outer wall 22*a* and a cross wall 22*b* at right angles to the wall 22*a*. In this case there is a third wall 22*c* parallel to the wall 22*a*. Each wall 22*b* is pierced and threaded at 22*c* to receive a bolt structure 23 which, as in the first embodiment, has a central noncircular gripping portion and two end portions extending in opposite directions and having right- and left-hand threads respectively fitting into similarly threaded bores in the walls 22*b*. Thus, as in the first embodiment, the manipulation of the bolted structures 23 permits the contraction and expansion of the generally circular structure 20 of the base members to enter into, and to be expanded radially outwardly, to fit the base member structure into the manhole housing 10.

The elevating member 24 comprises an upstanding vertical wall 24*a* having a dovetail base 24*b* and having a ledge 24*c* extending at right angles from the vertical portion 24*a* to receive a manhole cover 12*a* as shown in FIG. 6. Here again, as in the first embodiment, the elevating members 24 are each arcuately slidable into one of the base member sections 15*a* before the assembly is connected in a circle as shown in FIG. 5. In this case the dovetail portion 24*b* of the elevating member is placed in the suitable notch between the teeth 21 of the base member to hold the ledge 24*c* at the proper height so that the manhole cover 12*a* will be at the level of the resurfaced road 14.

Here, the base member 20*a* has its radially outermost wall sloping upwardly and outwardly as indicated at 20*b*′ at the same angle as the inclined wall 11*b* of the manhole housing to that when the complete assembly is fastened in a manhole housing the base members 20*a* fit tightly and snugly into the recess in the manhole housing.

Figure 8:
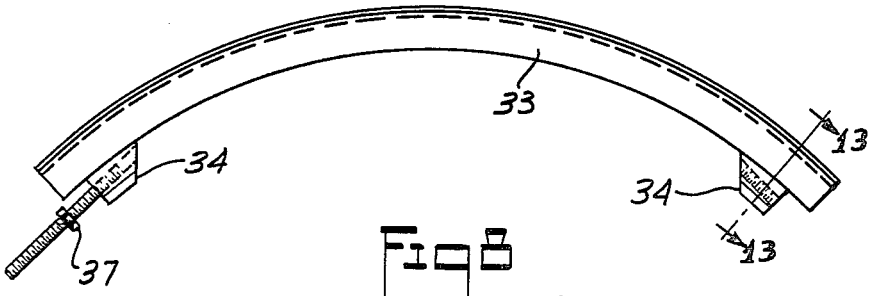
FIG. 8 is a plan view of one quadrant of another embodiment of this invention.
Figure 9:
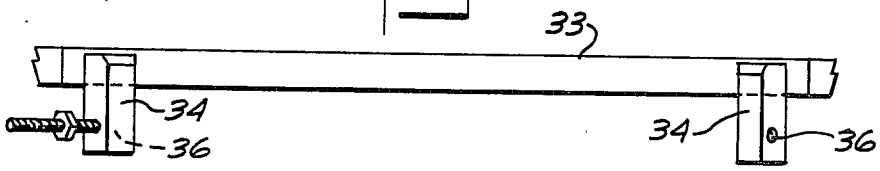
FIG. 9 is an elevational view taken from the lower side of FIG. 8.
Figure 10:
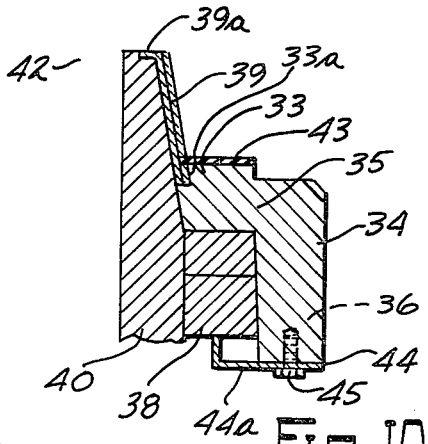
FIG. 10 is a sectional view enlarged taken along the line 10—10 of FIG. 8.

FIGS. 8, 9 and 10 show another embodiment of this invention. Four quadrants of arcuate base sections are represented by a single quadrant of such a section indicated at 25. Near each end of each quadrant there is an integral downwardly extending post 26 welded to the arcuate base section at 27. Each of these posts has respectively right-hand and left-hand threads 28 in adjacent ends of each pair of arcuate members. These are in a position to register with each other when the entire device is connected by joining four arcuate members by threaded members as originally indicated at 23 in FIGS. 5–7 and also at 16*a* in FIGS. 1–3. The arcuate base members 25 are assembled on a shelf 29 of the manhole housing 30. The manhole cover 31 when assembled on the arcuate base members lies about at the top of the surface or a resurfaced road indicated at 31.

It will be noted in FIGS. 9 and 10 that a lateral support member 32 is cast integrally with the base member 25 with the upper end of the lateral support member lying about at the top surface of the repaved road at 31.

Figure 13:
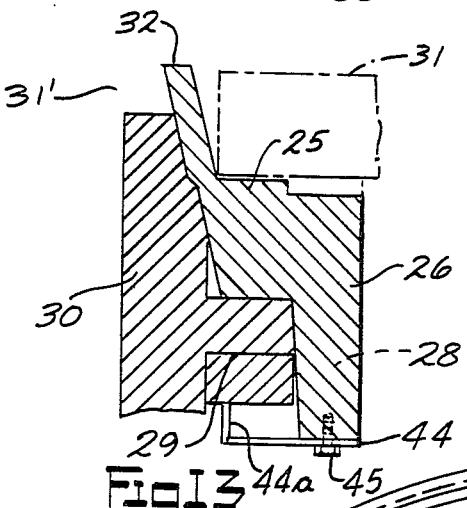
FIG. 13 is a sectional view slightly enlarged taken along the line 13—13 of FIG. 11 to which has been added the sealing ring and the lateral support member and a locking member.
Figure 11:
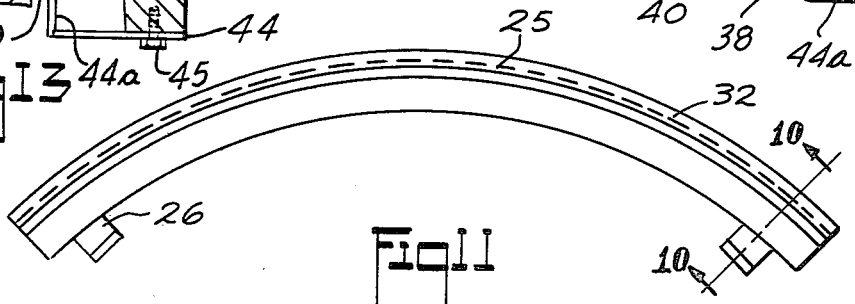
FIG. 11 is a plan view of still another quadrant of another embodiment of this invention.
Figure 12:
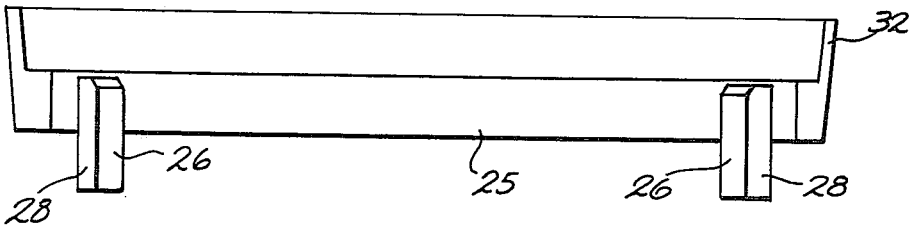

Another embodiment of this invention is shown in FIGS. 11, 12 and 13. FIG. 11 is a plan view of one of the four quadrants of base members 33 having welded thereto near each end a substantially integral downwardly extending post 34, each post being welded to its associated arcuate base member at 35. Each post 34, near its lower end, has a threaded opening 36, each of the posts having respectively right-hand and left-hand threads in adjacent ends of each pair of arcuate base members. These are intended to be connected together by a male bolt member 37 having its opposite ends respectively right-hand and left-hand threaded.

In this embodiment, each arcuate base member 35 has an outwardly opening arcuate recess 33*a* at the outer upper edge of the upper linear surface thereof which is preferably about one-eight to three-sixty fourths inches in radial depth and about one-quarter to three-eights inches in axial length, that is, vertically. After the four arcuate members 33 are assembled in substantially a circle resting on the shelf 38 of the manhole housing, a separate arcuate lateral support member 39 is substantially integrally secured into the outwardly opening arcuate recesses 33*a* as shown in FIG. 13. This preferably is by welding. At the upper edge of the lateral support member 39, an integral flange 39*a* extends radially outward for a short distance as shown in FIGS. 12 and 13. It will be noted in FIG. 13 that the manhole housing 40 has an integral peripheral face 40*a* sloping upwardly and outwardly in a linear fashion at a slight angle, about 10 degrees preferred. It will be noted that each end of each arcuate base member has an outer peripheral face 33*b* sloping upwardly and outwardly at the same slight angle.

The arcuate members of this embodiment are assembled on the shelf 38 of the manhole housing 40 at a level to cause the manhole cover 41 to remain approximately at the same level as the new road grade 42, with the flange 39*a* being at the same level.

In this embodiment, and in any of the other embodiments of this invention, a resilient annular flat seal 43 is firmly secured on the top surface of the quadrant arcuate member 33 in any suitable manner, an electro-chemical process being preferred.

As seen in FIG. 13, a locking piece 44 may be secured by a bolt 45 to the bottom of one or more of the posts 34, with the strip extending radially outwardly from the post, as at 44*a*, sufficiently to engage the underside of the shoulder 38 of the manhole housing if there is an attempt to lift the fittings of this invention out of the manhole housing.

The posts 26 and 34 of the last two embodiments may be placed between about three-quarters of an inch and one and one-half inches from the near end of the associated arcuate base member.

What is claimed is:

1. A sectional manhole cover support for vertically adjusting the level of a manhole cover in the opening of a manhole housing to a new road grade, wherein said manhole housing has at its upper edge an arcuate recess opening upwardly and also radially inwardly; each section of said support comprising generally arcuate base members adapted to be fixed within said opening against vertical movement downwardly in use thereof; said members comprising a plurality of arcuate base members collectively substantially forming a ring with an upper horizontal linear surface for supporting said manhole cover at a raised level; each of said base members having an integral downwardly extending post near each end thereof; each of said posts having respectively right-hand and left-hand threads in adjacent ends of each pair of base members; whereby coacting adjustable threaded bolt means may be affixed between adjacent posts for moving the sections of said base member circumferentially apart to expand said base member within said opening of said manhole housing to tightly engage said housing.

2. A sectional manhole cover support member as defined in claim 1, including a plurality of vertically adjustable elevating members assembleable each upon and conforming in shape to its associated base member for supporting a manhole cover; each of said elevating members and posts having means defining laterally directed support surfaces which complementarily interfit each other in different relative positions for adjustment of said adjustable elevating members in a vertical direction in said opening.

3. A sectional manhole cover support as defined in claim 1, wherein said base members are channel shaped in cross section with the open sides of the channels directed upwardly; said means defining laterally directed support surfaces including means on said base members providing teeth projecting inwardly from the inner side walls of said channels; said teeth dispose in horizontally aligned pairs on opposite inner walls of each channel at different levels and extending continuously throughout the arcuate length of each said section; said vertically adjustable elevating sections arcuately slidably interfitting said base sections and having compelementary laterally projecting teeth interfitting a selected number of the teeth of said base section channels at a selected level; said vertically adjustable elevating sections having vertical arcuate walls projecting upwardly out of said channel shaped base sections; said walls having horizontal ledge portions at their upper edges collectively forming a seat for receiving the annular edge portions of a manhole cover.

4. A sectional manhole cover support as defined in claim 3, said adjustable threaded bolt means comprising adjusting bolts having right- and left-hand threaded portions extending in opposite directions and thread fitted into said posts of adjacent of said base section members and which are adjustable to selectively move said sections together and away from each other.

5. A sectional manhole cover support as defined in claim 1, wherein said recess at the upper edge of said manhole housing has a horizontal flat bottom and an outer wall diverging upwardly and outwardly at a slight angle; said base members are each generally channel shape opening upwardly and with a flat outside bottom wall and a radially outermost wall, of which at least the lower portion slopes upwardly and outwardly at approximately the same slight angle as said recess.

6. A sectional manhole cover support member as defined in claim 1, wherein each of said posts is spaced inwardly of each end of its associated arcuate base member by an amount of about one to one and one-half inches, whereby said arcuate base members may be assembled with their adjacent ends more closely associated.

7. A sectional manhole cover support member as defined in claim 6, wherein said manhole housing arcuate recess has an inner peripheral face sloping upwardly and outwardly linearly at a slight angle, each end of each arcuate base member having an outer peripheral face sloping upwardly and outwardly at said same slight angle, each said arcuate base member having an outwardly opening arcuate recess at the outer edge of said upper lineal surface about one-eight to three-sixty-fourth inches in radial depth and about one-quarter to three-eights inches in axial length, and a separate arcuate lateral support member integrally secured to said assembled arcuate base members in said outwardly opening arcuate recess, said lateral support member having the thickness of said outwardly opening arcuate recesses and having a length to extend upwardly therefrom to said new road grade, and at its upper edge having a flange extending radially outward for a short distance.

8. A sectional manhole cover support member as defined in claim 1, wherein said manhole housing has a shoulder extending radially inwardly only beneath said arcuate base members, said posts extend radially inwardly beyond said shoulder, said arcuate base members having flat horizontally aligned upper lined surfaces, and a flat resilient circular seal strip firmly attached to said upper aligned surfaces.

9. A sectional manhole cover support member as defined in claim 8, including a coacting locking piece secured to the bottoms of at least some of said posts and extending radially outwardly therefrom sufficiently to engage beneath said shoulder if said posts are lifted.

* * * * *